US008544780B2

(12) United States Patent
Hoffmann et al.

(10) Patent No.: US 8,544,780 B2
(45) Date of Patent: Oct. 1, 2013

(54) OUTPUT-SIDE SUBASSEMBLY OF A MILL DRIVE SYSTEM AND MILL DRIVE SYSTEM

(75) Inventors: Bernhard Hoffmann, München (DE); Dirk Schroer, Rhede (DE)

(73) Assignee: Siemens Aktiengesellschaft, München (DE)

( * ) Notice: Subject to any disclaimer, the term of this patent is extended or adjusted under 35 U.S.C. 154(b) by 426 days.

(21) Appl. No.: 13/025,197

(22) Filed: Feb. 11, 2011

(65) Prior Publication Data

US 2011/0210196 A1 Sep. 1, 2011

(30) Foreign Application Priority Data

Feb. 12, 2010 (DE) ..... 10 2010 007 929

(51) Int. Cl.
*B02C 19/00* (2006.01)

(52) U.S. Cl.
USPC ..... 241/101.2; 241/301

(58) Field of Classification Search
USPC ..... 241/101.2, 301
See application file for complete search history.

(56) References Cited

FOREIGN PATENT DOCUMENTS

| | | | |
|---|---|---|---|
| DE | 3534940 | A1 | 5/1986 |
| DE | 3712562 | C1 | 8/1988 |
| DE | 3931116 | A1 | 3/1991 |
| GB | 943176 | A | 4/1963 |
| JP | 2005052799 | A | 3/2005 |

*Primary Examiner* — Mark Rosenbaum

(57) ABSTRACT

An output-side subassembly of a mill drive system is provided. The subassembly includes an output flange, connectable to a grinding dish, for absorbing forces occurring in a grinding process. Moreover, an annular basic element which is mountable on a foundation or carrier element is provided. For supporting the output flange, a plurality of axial plain bearing segments are arranged essentially equidistantly with respect to one another on the annular basic element. In this case, lubricating gaps are formed in each case between the output flange and the axial plain bearing segments.

5 Claims, 2 Drawing Sheets

OUTPUT-SIDE SUBASSEMBLY OF A MILL DRIVE SYSTEM AND MILL DRIVE SYSTEM

CROSS REFERENCE TO RELATED APPLICATIONS

This application claims priority of German Patent Application No. 10 2010 007 929.4 DE filed Feb. 12, 2010, which is incorporated by reference herein in its entirety.

FIELD OF INVENTION

The invention relates to an output-side subassembly of a mill drive system and to a mill drive system which comprises such an output-side subassembly.

BACKGROUND OF INVENTION

Known mill drive systems often comprise a large toothed ring which is arranged in spatial proximity to the treatment process. The toothed ring, together with further gear stages and with one or more electric motors, frequently forms a drive train. The further gear stages are usually arranged in a dedicated gear case which has to be aligned exactly with a common foundation.

DE 35 34 940 A1 describes a drive device for a toothed ring of a rotary tube, the drive power of which drive device is branched in a gear case to two output pinions meshing with a toothed ring. For free movability with respect to the toothed ring for setting purposes, crowned denture clutches and spherical mountings are provided in each case for the two output pinions. In this case, an intermediate stage of the gear must have free axial movability for setting purposes. Since the two output pinions are positioned fixedly with respect to one another, the gear has to be aligned relatively accurately with a common foundation. However, the crowned denture clutches cannot compensate superposed alignment errors.

DE 39 31 116 A1 discloses a drive device for a vertical mill, in which the gear case and mill housing are firmly screwed together. Consequently axes, lying far apart from one another, of the drive pinion and toothed ring have to be positioned exactly with respect to one another. A tiltably movable mounting is provided for the drive pinion, but is not sufficient for compensating excessive constraining forces.

JP 2005052799 A describes a drive device for a vertical crusher, said drive device comprising a gear unit which can be demounted as a unit for maintenance purposes. An output-side gear stage has essentially no movability for setting purposes, in order to decouple impact loads due to the treatment process from the gear unit.

In many conventional mill drive systems, forces occurring in a treatment process are in each case introduced via a plinth into a foundation or a frame by means of a plurality of axial plain bearing elements. The foundation or the frame may for manufacturing reasons have, on a bearing surface for the housing parts, pronounced dimensional and planeness tolerances which result in considerable height differences. In order to keep lubricating gaps on the plain bearing elements within a required height tolerance range, height differences of the individual plain bearing elements have to be compensated in a complicated way by manual setting. For this purpose, the foundation or the frame usually has to be measured exactly. For height compensation, setting plates are used, for example, which are mounted individually for each plinth.

SUMMARY OF INVENTION

An object is to provide an output-side subassembly for a mill drive system, which subassembly allows the mill drive system to be decoupled from forces occurring in a treatment process and also makes it possible to mount the mill drive system in a simplified way, and also to specify a corresponding mill drive system.

This object is achieved by an output-side subassembly for a mill drive system and by a mill drive system as claimed in the independent claims. Advantageous developments of the present invention are specified in the dependent claims.

The output-side subassembly according to the invention comprises an output flange, connectable to a grinding dish, for absorbing forces occurring in a grinding process. Moreover, an annular basic element which is mountable on a foundation or carrier element is provided. For supporting the output flange, a plurality of axial plain bearing segments are arranged essentially equidistantly with respect to one another on the annular basic element. In this case, lubricating gaps are formed in each case between the output flange and the axial plain bearing segments. Connectable to the output flange is a toothed ring which can be brought into engagement with at least one spur pinion of a drive module in each case. By an annular basic element of definable rigidity being used, unevennesses within a foundation or carrier element can be compensated efficiently and outlay for mounting purposes can be reduced. Moreover, the output-side subassembly according to the invention enables essential components of a mill drive system to be decoupled effectively from forces acting upon the output flange in a treatment process.

According to the invention, the basic element comprises an annular element of predeterminable rigidity which projects beyond a basic body connectable to the foundation or carrier element. The annular element is hollow at least in sections, and the axial plain bearing segments are mounted on the annular element.

The annular element may have a profile resembling a hollow U-shape on a radial outer side and on a radial inner side. In this case, the annular element is configured for compensating unevennesses of the foundation or carrier element under load in the axial direction and is open on an axial end face facing away from the axial plain bearing segments. As an alternative to this, the annular element may have a continuous groove of parabola-like cross section on an axial end face facing away from the axial plain bearing segments. According to a further alternative embodiment, the annular element comprises a radial wall which runs in sections alternately at a first and at a second radial distance from the center of the annular element. Moreover, in this case, the radial wall is connected, on a side facing the axial plain bearing segments, to a continuous annular plate on which the axial plain bearing segments are mounted.

The mill drive system according to the invention comprises at least one drive module which has a motor and a spur pinion, connected to the latter, of a spur wheel stage. Moreover, an output flange, connectable to a grinding dish, is provided for absorbing forces occurring in a grinding process. Furthermore, the mill drive system according to the invention comprises an annular basic element which is mountable on a foundation or carrier element. A plurality of axial plain bearing segments for supporting the output flange are arranged essentially equidistantly with respect to one another on the annular basic element. In this case, lubricating gaps are foamed in each case between the output flange and the axial plain bearing segments. A toothed ring is connectable to the output flange and can be brought into engagement with at least one spur pinion of a drive module.

BRIEF DESCRIPTION OF THE DRAWINGS

The present invention is explained in more detail below by means of an exemplary embodiment. In the drawing.

DETAILED DESCRIPTION OF INVENTION

Figure 1:
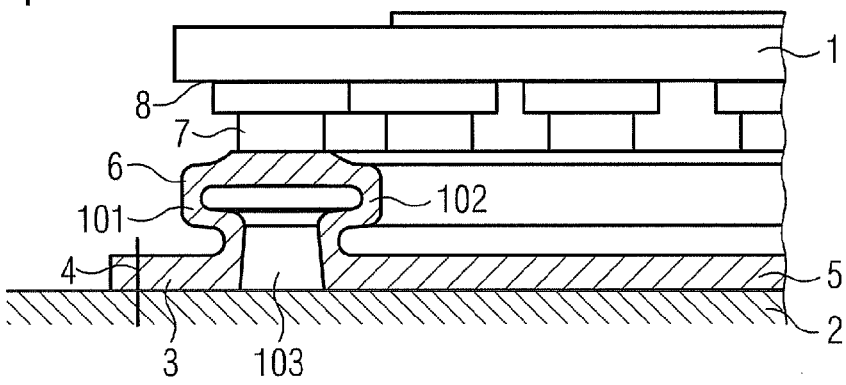
FIG. 1 shows a first embodiment of an output-side subassembly of a mill drive system.
Figure 4:
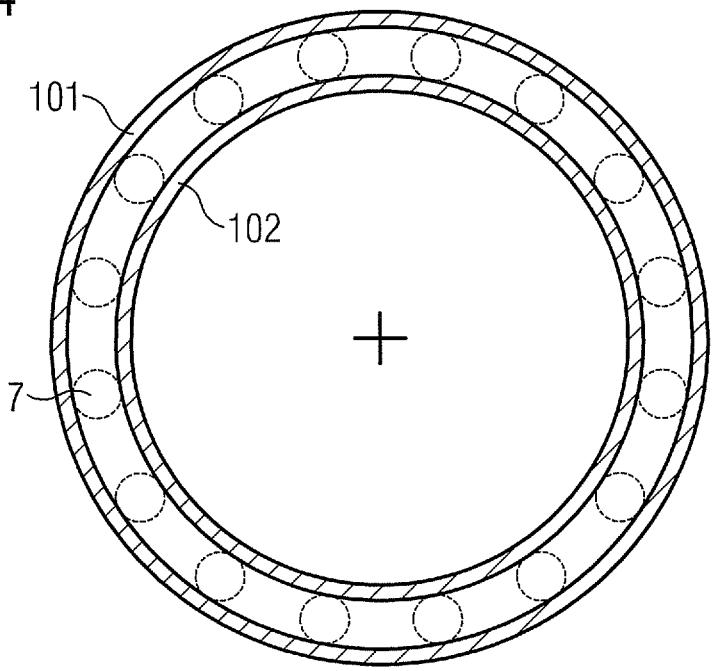
FIG. 4 shows a cross-sectional illustration through an annular element of the subassembly illustrated in FIG. 1.

The output-side subassembly, illustrated in FIG. 1, of a mill drive system has an output flange 1, connectable to a grinding dish, for absorbing forces occurring in a grinding process. An annular basic element 3 is mounted on a foundation 2 by means of fastening elements 4. The basic element 3 comprises a hollow annular element 6 which projects beyond a basic body 5 connected to the foundation 2 and which has a predeterminable rigidity. For supporting the output flange 1, a plurality of axial plain bearing segments 7 are arranged essentially equidistantly with respect to one another on the annular element 6. This may also be gathered from the cross-sectional illustration according to FIG. 4. Between the output flange 1 and the axial plain bearing segments 7 are formed in each case lubricating gaps 8, by means of which the output flange 1 is mounted axially, using plain bearings. A toothed ring, not illustrated explicitly in the figures, may be connected to the output flange 1 and is in engagement with a spur pinion of a drive module.

The annular element 6 has a profile resembling a hollow U-shape on a radial outer side 101 and on a radial inner side 102 and is configured for compensating unevenesses of the foundation 2 under load in the axial direction. Moreover, the annular element 6 is open on an axial end face 103 facing away from the axial plain bearing segments 7. By means of FEM calculation methods, the annular element 6 is dimensioned in such a way that deformation travels are defined in the axial direction as a result of a directed rigidity of the annular element 6 and make it possible to compensate unevennesses of the foundation 2. Thus, the lubricating gap 8 is not adversely influenced, and stresses within the annular element 6 can, even under load, be kept within a permissible range.

Figure 2:
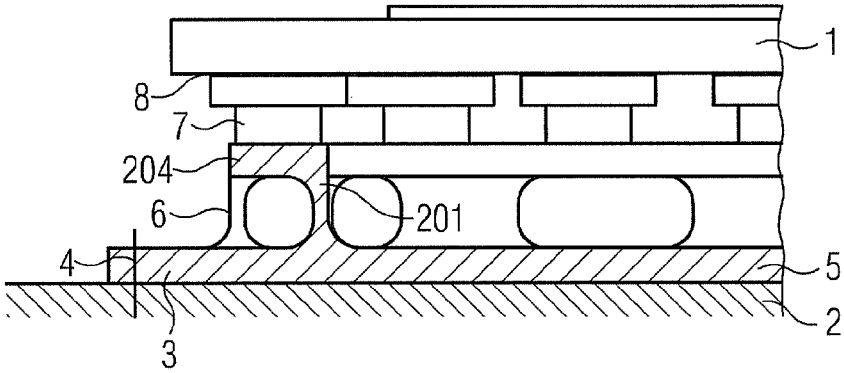
FIG. 2 shows a second embodiment of an output-side subassembly of a mill drive system.
Figure 5:
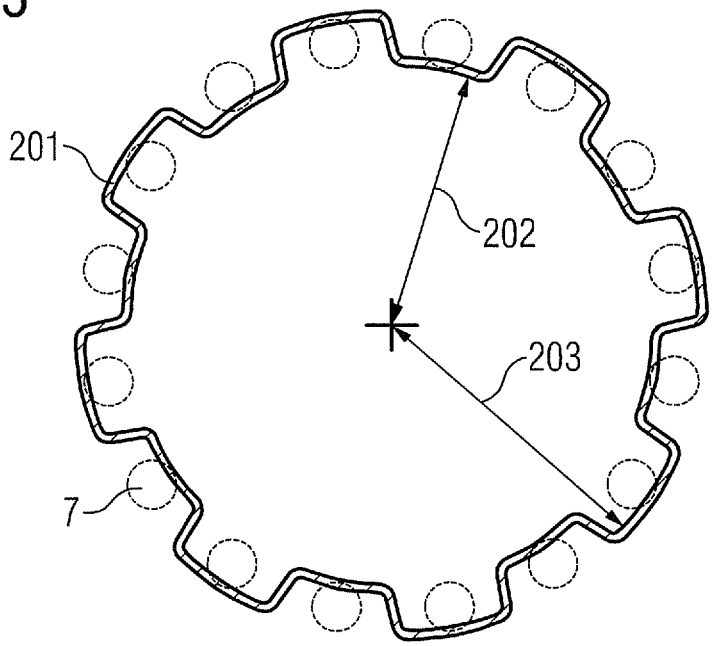
FIG. 5 shows a cross-sectional illustration through an annular element of the subassembly illustrated in FIG. 2.

In the embodiment illustrated in FIG. 2, the annular element comprises a radial wall 201 which runs in sections alternately at a first radial distance 202 and at a second radial distance 203 from the center of the annular element 6 (see also FIG. 5). The axial plain bearing segments 7 in this case lie in the middle in each case within a portion of the radial wall 201. On a side facing the axial plain bearing segments 7, the radial wall 201 is connected to a continuous annular plate 204 on which the axial plain bearing segments 7 are mounted.

Figure 3:
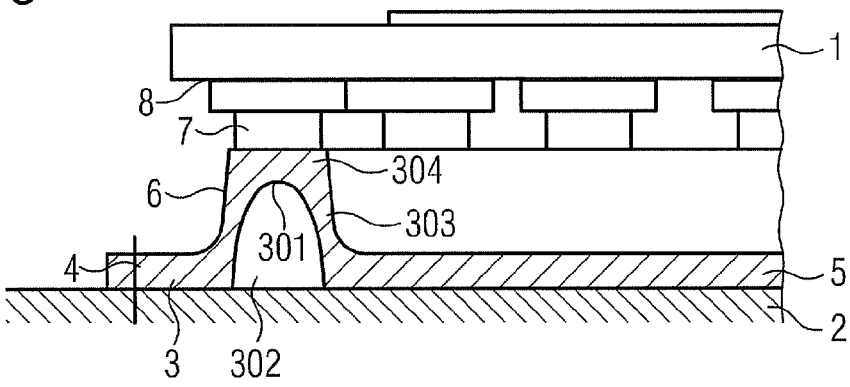
FIG. 3 shows a third embodiment of an output-side subassembly of a mill drive system.

The output-side subassembly corresponding to the embodiment according to FIG. 3 comprises an annular element 6 which, on an axial end face 302 facing away from the axial plain bearing segments 7, has a continuous groove 301 of parabola-like cross section. In this case, lateral walls 303 are spread vertically outward at a slight oblique angle. The lateral walls 303 are connected to a baseplate 304 on which the axial plain bearing segments 7 are arranged. In the embodiment according to FIG. 3, unevennesses within the foundation 2 between the lateral walls 303 are of no consequence.

Advantageously, the basic element 3 is configured, by virtue of directed rigidity properties, in such a way that it is designed to be only as soft as is necessary to be able to compensate unevennesses in the foundation 2. Thus, there is no adverse influence upon the lubricating gap 8 between the output flange 1 and the individual axial plain bearing segments 7. Moreover, a coherent peripheral annular element 6 which is hollow in sections affords greater height tolerance with respect to unevennesses in the foundation 2, as compared with axial plain bearing segments 7 arranged on separate plinths.

The embodiments described afford the advantage that complicated remeasurements and settings when mill drive systems are being installed may be dispensed with, as compared with conventional solutions. Moreover, the embodiments described have a substantially simplified structural set-up and a reduced number of parts, thus resulting in markedly lower production, storage and assembly costs.

The use of the present invention is not restricted to the exemplary embodiments described.

The invention claimed is:

1. An output-side subassembly of a mill drive system, comprising:

an output flange, connectable to a grinding dish, for absorbing forces occurring in a grinding process;

an annular basic element which is mountable on a foundation or carrier element and which comprises an annular element of predeterminable rigidity which projects beyond a basic body connectable to the foundation or carrier element and is hollow at least in sections;

a plurality of axial plain bearing segments, arranged essentially equidistantly with respect to one another on the annular basic element, for supporting the output flange, said axial plain bearing segments being mounted on the annular element of predeterminable rigidity, lubricating gaps being formed in each case between the output flange and the axial plain bearing segments; and a toothed ring which is connected to the output flange and which can be brought into engagement with at least one spur pinion of a drive module in each case.

2. The subassembly as claimed in claim 1, wherein the annular element includes a profile resembling a hollow U-shape on a radial outer side and on a radial inner side in order to compensate unevenness of the foundation or carrier element under load in the axial direction, and wherein the annular element is open on an axial end face facing away from the axial plain bearing segments.

3. The subassembly as claimed in claim 1, wherein the annular element includes a continuous groove of parabola-like cross section on an axial end face facing away from the axial plain bearing segments.

4. The subassembly as claimed in claim 1, wherein the annular element comprises a radial wall which runs in sections alternately at a first and at a second radial distance from the center of the annular element, and in which the radial wall is connected, on a side facing the axial plain bearing segments, to a continuous annular plate on which the axial plain bearing segments are mounted.

5. A mill drive system, comprising:

at least one drive module which comprises a motor and a spur pinion of a spur wheel stage, the spur pinion being connected to the motor;

an output flange, connectable to a grinding dish, for absorbing forces occurring in a grinding process;

an annular basic element which is mountable on a foundation or carrier element and which comprises an annular element of predeterminable rigidity which projects beyond a basic body connectable to the foundation or carrier element and is hollow at least in sections;

a plurality of axial plain bearing segments, arranged essentially equidistantly with respect to one another on the annular basic element, for supporting the output flange, said axial plain bearing segments being mounted on the annular element of predeterminable rigidity, lubricating gaps being formed in each case between the output flange and the axial plain bearing segments; and a toothed ring which is connected to the output flange and which can be brought into engagement with at least one spur pinion of a drive module.

* * * * *